US009674603B1

(12) United States Patent
Yeh et al.

(10) Patent No.: US 9,674,603 B1
(45) Date of Patent: Jun. 6, 2017

(54) COAXIAL SPEAKER

(71) Applicant: PAL Acoustics Technology Ltd., Taipei (TW)

(72) Inventors: Chun-Hui Yeh, New Taipei (TW); Hsiu-Chen Hsu, New Taipei (TW)

(73) Assignee: PAL Acoustics Technology Ltd., Taipei (TW)

( * ) Notice: Subject to any disclaimer, the term of this patent is extended or adjusted under 35 U.S.C. 154(b) by 0 days.

(21) Appl. No.: 15/052,829

(22) Filed: Feb. 24, 2016

(51) Int. Cl.

| | |
|---|---|
| ***H04R 9/06*** | (2006.01) |
| ***H04R 1/28*** | (2006.01) |
| ***H04R 1/24*** | (2006.01) |
| ***H04R 7/18*** | (2006.01) |
| ***H04R 9/02*** | (2006.01) |
| ***H04R 1/02*** | (2006.01) |

(52) U.S. Cl.
CPC ..... *H04R 1/2888* (2013.01); *H04R 1/023* (2013.01); *H04R 1/24* (2013.01); *H04R 7/18* (2013.01); *H04R 9/025* (2013.01); *H04R 9/063* (2013.01)

(58) Field of Classification Search
CPC combination set(s) only.
See application file for complete search history.

(56) References Cited

U.S. PATENT DOCUMENTS 4,438,297 A * 3/1984 Kawamura ..... H04R 9/063 381/401
7,360,626 B2 * 4/2008 Sahyoun ..... H04R 7/122 181/163

* cited by examiner

*Primary Examiner* — Amir Etesam
(74) *Attorney, Agent, or Firm* — Winston Hsu

(57) ABSTRACT

A coaxial speaker includes a frame, a magnetic steel component, a magnetic component, a magnetic conductive component, a first cover, a first speaker assembly, and a second speaker assembly. The magnetic steel component, the magnetic component, and the magnetic conductive component are disposed inside the frame sequentially. A first accommodating space is formed among the magnetic component, the magnetic conductive component, and the magnetic steel component. A second accommodating space is formed among the magnetic component, the magnetic conductive component, the magnetic steel component, and the frame. The first speaker assembly is fixed between the first cover and the frame and is disposed in the first accommodating space for producing low and middle audio frequencies. The second speaker assembly is fixed on the first cover and disposed in the second accommodating space for producing high audio frequencies. In such a way, the coaxial speaker has enhanced sound quality.

12 Claims, 5 Drawing Sheets

COAXIAL SPEAKER

BACKGROUND OF THE INVENTION

1. Field of the Invention

The present invention relates to a speaker, and more particularly, to a coaxial speaker capable of enhancing sound quality, improving sound localization, and reducing phase difference between sound signals.

2. Description of the Prior Art

A conventional speaker usually includes only one single speaker unit. However, it is difficult for the one single speaker unit to have good sound quality in high audio frequencies, middle frequencies, and low frequencies due to technical limitations. In order to enhance customers' audio experience, there is another conventional speaker including two speaker units disposed separately, such as a tweeter and a woofer. The tweeter is designed for generating sound signals with high audio frequencies, and the woofer is designed for generating sound signals with low audio frequencies. However, since the tweeter and the woofer are disposed at different positions, sound signals with the high audio frequencies generated by the tweeter and sound signals with the low audio frequencies generated by the woofer are transmitted from different positions, which has negative effects on sound localization and phase difference between sound signals. Therefore, there is a need to design a speaker capable of enhancing sound quality, improving sound localization, and reducing phase difference between sound signals.

SUMMARY OF THE INVENTION

In order to solve the aforementioned drawbacks, the present invention is to provide a coaxial speaker capable of enhancing sound quality, improving sound localization, and reducing phase difference between sound signals.

According to the claimed invention, a coaxial speaker includes a frame, a magnetic steel component, a magnetic component, a magnetic conductive component, a first cover, a first speaker assembly, and a second speaker assembly. A recess is formed on the frame. The magnetic steel component is disposed inside the recess. An outer periphery of the magnetic steel component protrudes from a base of the magnetic steel component. The magnetic component is disposed on the base of the magnetic steel component. The magnetic conductive component is disposed on the magnetic component. A first accommodating space is formed among the magnetic component, an outer periphery of the magnetic conductive component, and the magnetic steel component. A second accommodating space is formed among the magnetic component, an inner periphery of the magnetic conductive component, the base of the magnetic steel component, and the frame. An outer periphery of the first cover is fixed on the frame, and an inner periphery of the first cover being fixed on the magnetic conductive component. The first speaker assembly includes a first diaphragm and a first voice coil. The first diaphragm is fixed between the first cover and the frame. The first diaphragm includes a first fixing structure protruding toward the first accommodating space. The first voice coil is disposed in the first accommodating space and fixed on the first fixing structure. The second speaker assembly includes a second diaphragm and a second voice coil. The second diaphragm is fixed on the inner periphery of the first cover. The second diaphragm includes a second fixing structure protruding toward the second accommodating space. The second voice coil is disposed in the second accommodating space and fixed on the second fixing structure.

According to the claimed invention, the coaxial speaker further includes a second cover disposed on the first cover at a location between the outer periphery of the first cover and the inner periphery of the first cover for covering the second speaker assembly.

According to the claimed invention, the coaxial speaker further includes a terminal disposed on a side of the outer periphery of the frame opposite to the first cover, and the first voice coil and the second voice coil are electrically connected to the terminal.

According to the claimed invention, a first slot and a second slot are formed on the outer periphery of the frame. A third slot is formed on the first cover and aligned with the second slot. The coaxial speaker further includes a first wire and a second wire. The first wire passes through the first slot for electrically connecting the first voice coil to the terminal, and the second wire passes through the third slot and the second slot for electrically connecting the second voice coil to the terminal.

According to the claimed invention, a plurality of communicating slots is formed on the outer periphery of the frame and corresponding to the first diaphragm. The coaxial speaker further includes a damping component disposed on a side of the outer periphery of the frame opposite to the first cover for regulating an air flow rate passing through the plurality of communicating slots.

According to the claimed invention, a notch is formed on the damping component and corresponding to the terminal, such that the damping component is formed in a C shape.

According to the claimed invention, a communicating hole is formed on a center of the frame and corresponding to the second diaphragm. The coaxial speaker further includes a damping element disposed on the center of the frame opposite to the second cover for regulating an air flow rate passing through the communicating hole.

According to the claimed invention, the damping element is formed in a circular shape.

According to the claimed invention, the first diaphragm and the second diaphragm are located in a same plane.

According to the claimed invention, the first diaphragm is formed in a ring shape. An outer periphery of the first diaphragm is fixed between the first cover and the frame, and the first fixing structure is disposed on an inner periphery of the first diaphragm.

According to the claimed invention, the second diaphragm is formed in a circular shape, and an outer periphery of the second diaphragm is fixed on the inner periphery of the first cover.

According to the claimed invention, the coaxial speaker further includes an anti-dust mesh disposed on the first cover.

In summary, the coaxial speaker of the present invention utilizes the magnetic component, the magnetic steel component, and the magnetic conductive component for establishing two independent magnetic loops in the first accommodating space and the second accommodating space. In such a way, the first voice coil disposed in the first accommodating space and the second voice coil disposed in the second accommodating space are driven by the two magnetic loops to drive the first diaphragm and the second diaphragm to vibrate for generating sound waves with low audio frequencies, middle audio frequencies, and high audio frequencies respectively. Therefore, the coaxial speaker of the present invention not only saves mechanical space but also enhances sound quality in high frequencies, middle frequencies, and low frequencies. Furthermore, since the first diagram and the second diagram are substantially located at the same plane, the coaxial speaker improves sound localization and reduces phase difference between sound signals.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
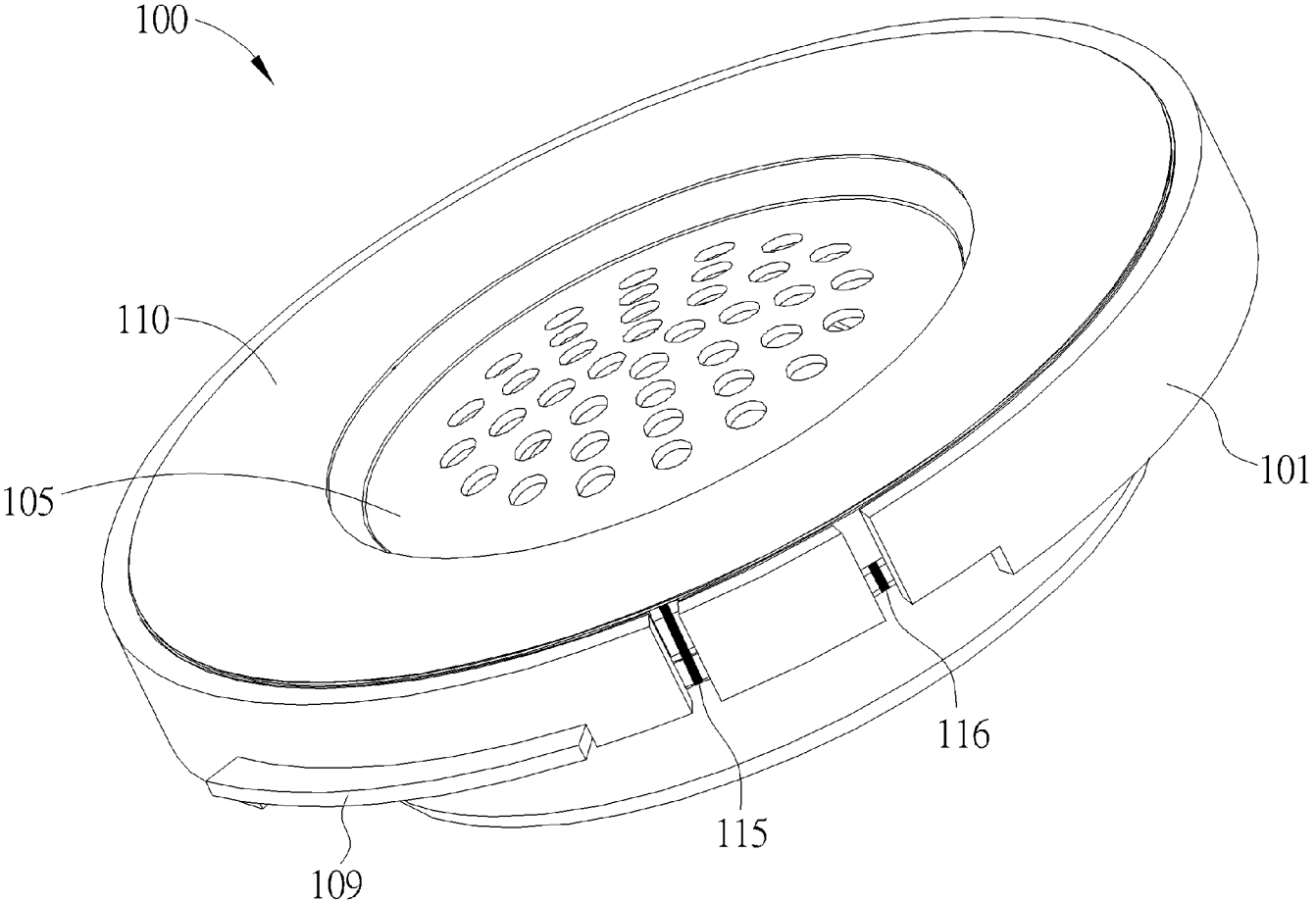
FIG. 1 is a schematic diagram of a coaxial speaker according to an embodiment of the present invention.
Figure 2:
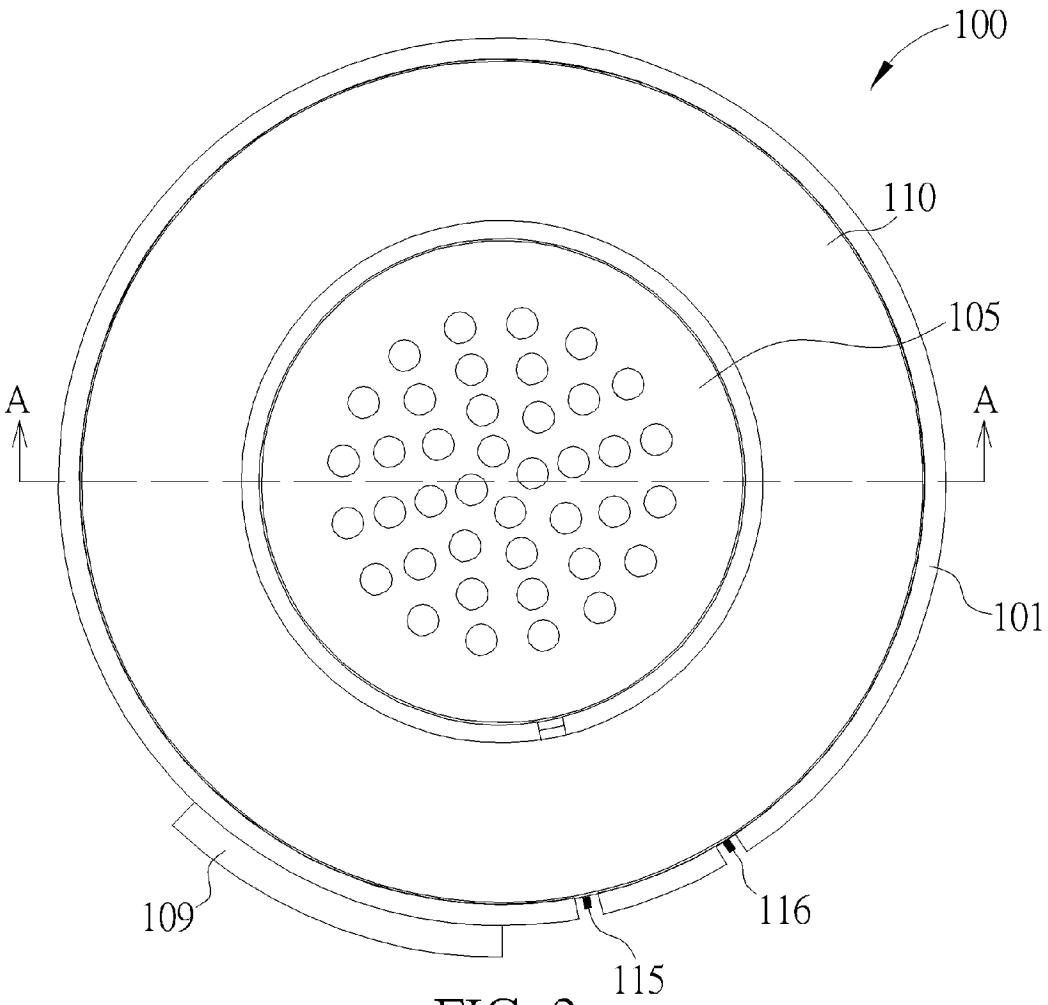
FIG. 2 is a lateral diagram of the coaxial speaker according to the embodiment of the present invention.
Figure 3:
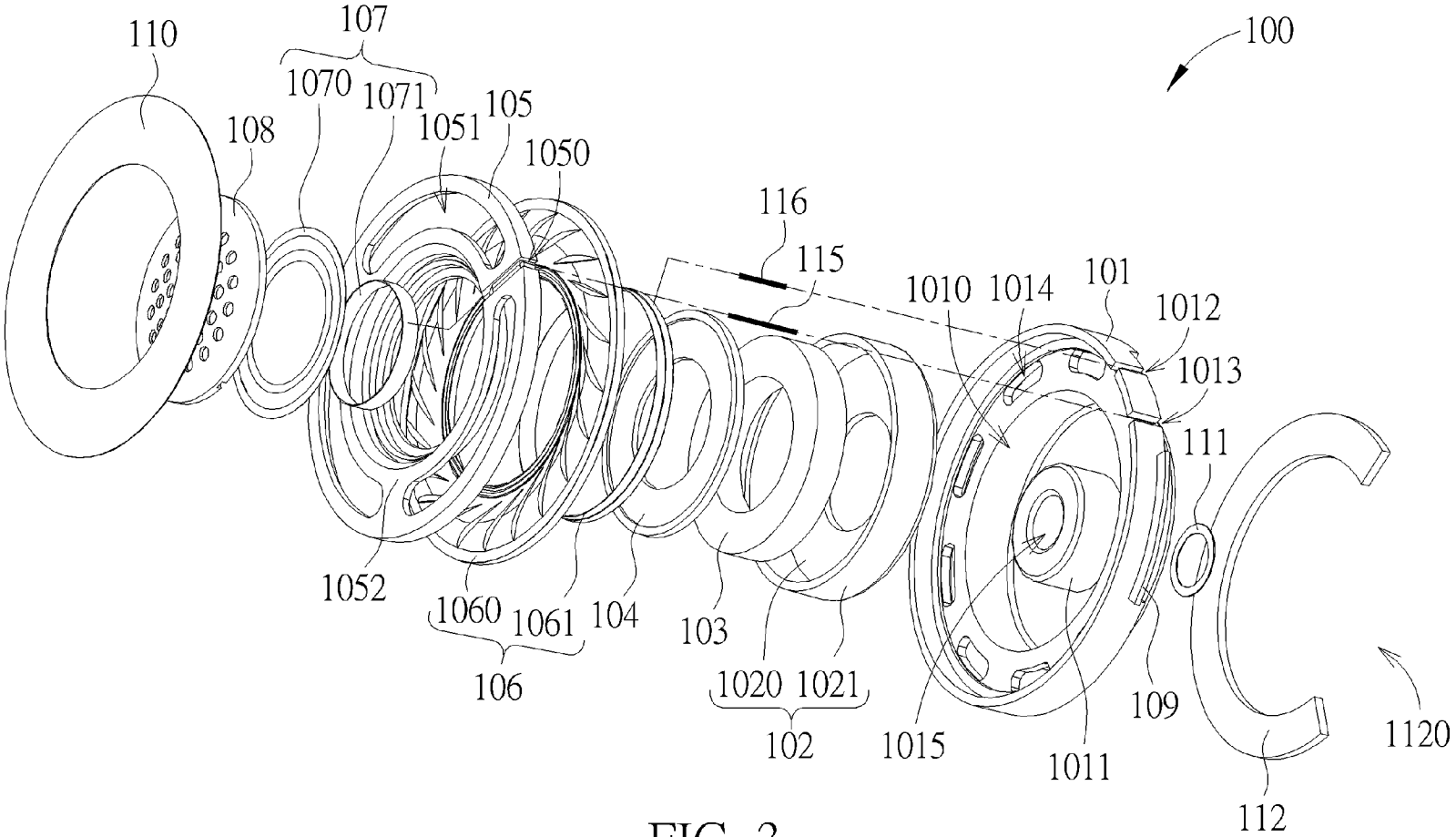
FIG. 3 and FIG. 4 are exploded diagrams of the coaxial speaker at different views according to the embodiment of the present invention.
Figure 4:
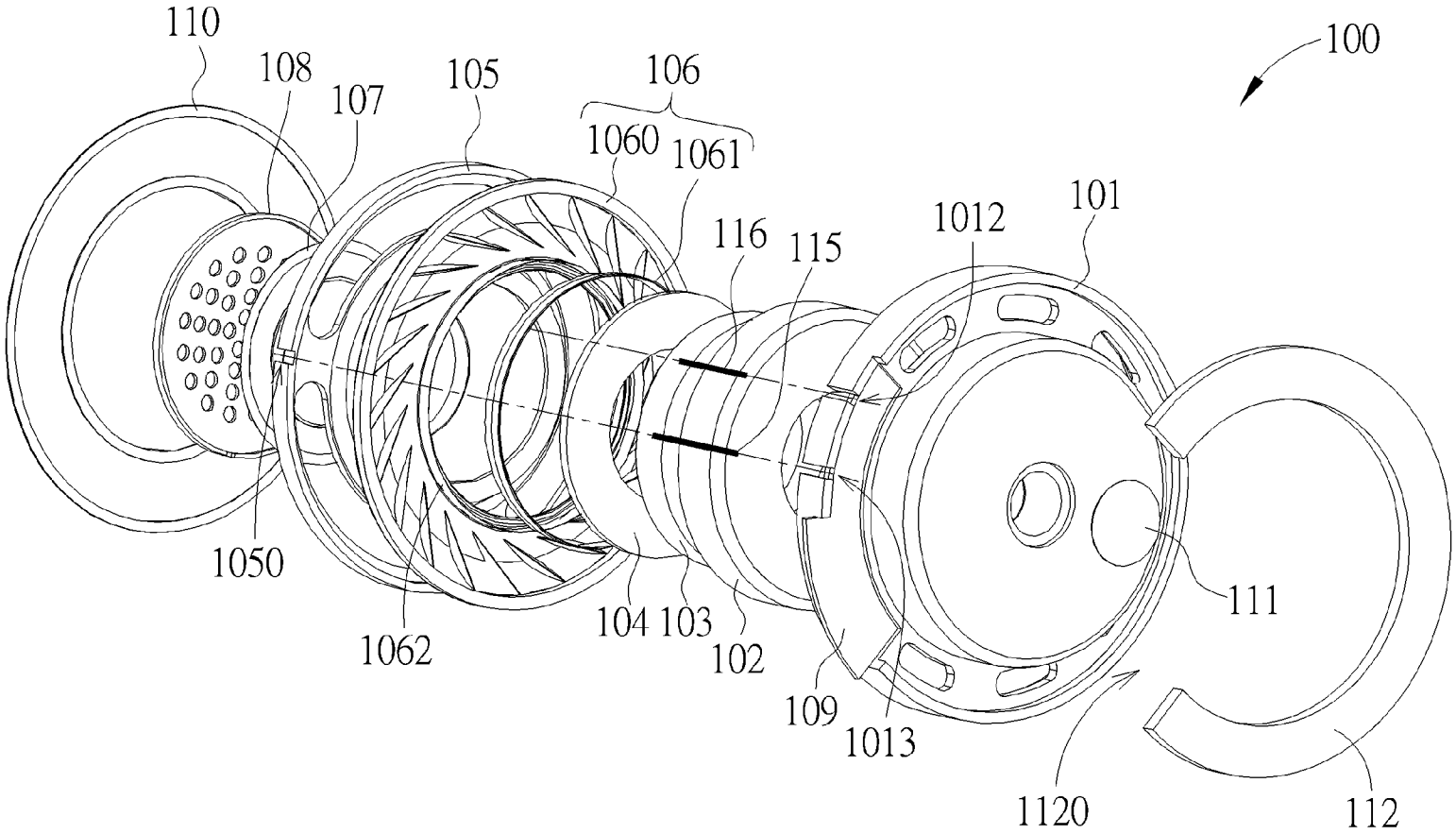
Figure 5:
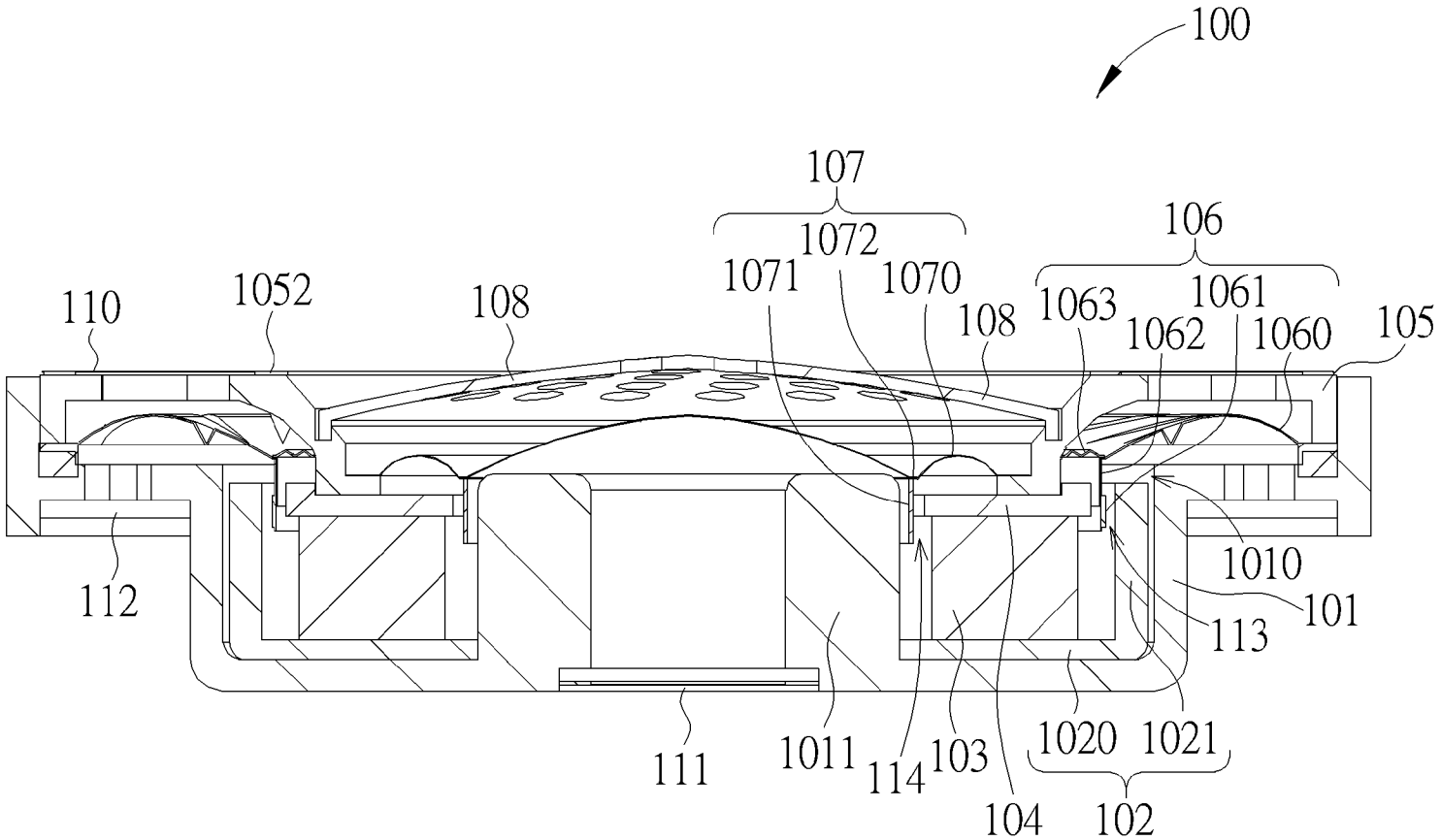
FIG. 5 is a sectional diagram of the coaxial speaker according to the embodiment of the present invention.

Please refer to FIG. 1 to FIG. 4. FIG. 1 is a schematic diagram of a coaxial speaker 100 according to an embodiment of the present invention. FIG. 2 is a lateral diagram of the coaxial speaker 100 according to the embodiment of the present invention. FIG. 3 and FIG. 4 are exploded diagrams of the coaxial speaker 100 at different views according to the embodiment of the present invention. FIG. 5 is a sectional diagram of the coaxial speaker 100 according to the embodiment of the present invention. As shown in FIG. 1 to FIG. 5, the coaxial speaker 100 includes a frame 101, a magnetic steel component 102, a magnetic component 103, a magnetic conductive component 104, a first cover 105, a first speaker assembly 106, a second speaker assembly 107, a second cover 108, a terminal 109, an anti-dust mesh 110, a damping element 111, and a damping component 112.

As shown in FIG. 3 to FIG. 5, the frame 101 is for supporting the other components, and a recess 1010 is formed on the frame 101. The magnetic steel component 102 is disposed inside the recess 1010. An outer periphery of the magnetic steel component 102 protrudes from abase 1020 of the magnetic steel component 102. The magnetic component 103 is disposed on the base 1020 of the magnetic steel component 102. The magnetic conductive component 104 is disposed on the magnetic component 103. Both of the magnetic conductive component 104 and the magnetic steel component 102 are for conducting and concentrating magnetic lines of flux from the magnetic component 103. As shown in FIG. 5, a first accommodating space 113 is formed among the magnetic component 103, an outer periphery of the magnetic conductive component 104, and the magnetic steel component 102. A second accommodating space 114 is formed among the magnetic component 103, an inner periphery of the magnetic conductive component 104, the base 1020 of the magnetic steel component 102, and the frame 101.

Specifically, in this embodiment, the recess 1010, the magnetic steel component 102, the magnetic component 103, and the magnetic conductive component 104 can be formed in ring shapes. The frame 101 includes a column 1011 protruding from a center of the frame 101. The magnetic steel component 102 is received in the recess 1010. The outer periphery of the magnetic steel component 102 protrudes from the base 1020 of the magnetic steel component 102 to form a surrounding wall 1021. The magnetic component 103 is disposed on the base 1020 of the magnetic steel component 102. The magnetic conductive component 104 is disposed on the magnetic component 103. The magnetic conductive component 104 and the magnetic component 103 are disposed in between and spaced from the surrounding wall 1021 and the column 1011, such that the outer periphery of the magnetic component 103, the outer periphery of the magnetic conductive component 104, the base 1020, and the surrounding wall 1021 of the magnetic steel component 102 form the first accommodating space 113 cooperatively, and the inner periphery of the magnetic component 103, the inner magnetic conductive component 104, the base 1020 of the magnetic steel component 102, and the column 1011 of the frame 101 form the second accommodating space 114 cooperatively. The magnetic component 103, the magnetic steel component 102, and the magnetic conductive component 104 establish two independent magnetic loops in the first accommodating space 113 and the second accommodating space 114, respectively. That is, the first speaker assembly 106 and the second speaker assembly 107 share the same magnetic components of the magnetic component 103, the magnetic steel component 102, and the magnetic conductive component 104, to establish two separated magnetic loops in two separated accommodating spaces, which reduces mechanical space and manufacturing cost effectively.

An outer periphery of the first cover 105 is fixed on the frame 101, and an inner periphery of the first cover 105 is fixed on the magnetic conductive component 104. The first speaker assembly 106 includes a first diaphragm 1060 and a first voice coil 1061. The first voice coil 1061 is for driving the first diaphragm 1060 to generate sound waves with low audio frequencies and middle audio frequencies. The first diaphragm 1060 is fixed between the first cover 105 and the frame 101. The first diaphragm 1060 includes a first fixing structure 1062. The first fixing structure 1062 protrudes toward the first accommodating space 113. The first voice coil 1061 is disposed in the first accommodating space 113 and fixed on the first fixing structure 1062. The second speaker assembly 107 includes a second diaphragm 1070 and a second voice coil 1071. The second voice coil 1071 is for driving the second diaphragm 1070 to generate sound waves with high audio frequencies. The second diaphragm 1070 is fixed on the inner periphery of the first cover 105. The second diaphragm 1070 includes a second fixing structure 1072 protruding toward the second accommodating space 114. The second voice coil 1071 is disposed in the second accommodating space 114 and fixed on the second fixing structure 1072. The first diaphragm 1060 adapted for low audio frequencies and middle audio frequencies can have a larger area and be made of softer material than ones of the second diaphragm 1070 adapted for high audio frequencies.

Specifically, in this embodiment, as shown in FIG. 3 and FIG. 4, the first diaphragm 1060 can be formed in a ring shape and vibrate for generating sound waves with low audio frequencies and middle audio frequencies, and the second diaphragm 1070 can be formed in a circular shape and for generating sound waves with high audio frequencies. The first speaker assembly 106 can further include a resilient supporting component 1063. An outer periphery of the first diaphragm 1060 is fixed between the outer periphery of the first cover 105 and the frame 101, and the first fixing structure 1062 is disposed on an inner periphery of the first diaphragm 1060. The first voice coil 1061 is disposed in the first accommodating space 113 and fixed on the first fixing structure 1062. The resilient supporting component 1063 is disposed between the inner periphery of the first diaphragm 1060 and the first cover 105 for resiliently supporting the first diaphragm 1060. An outer periphery of the second diaphragm 1070 is fixed on the inner periphery of the first cover 105. Preferably, as shown in FIG. 5, a top surface of the first cover 105 is declined from the outer periphery of the first cover 105 to the inner periphery of the first cover 105, such that second diaphragm 1070 and the first diaphragm 1060 are substantially located in a same plane, which effectively reduces phase difference between sound signals with different frequencies.

The second cover 108 is disposed on the first cover 105 at a location between the outer periphery of the first cover 105 and the inner periphery of the first cover 105 for covering the second diaphragm 1070, the second fixing structure 1072, and the second voice coil 1071 of the second speaker assembly 107, which prevents dust from dropping into the second speaker assembly 107. The terminal 109 is disposed on a side of the outer periphery of the frame 101 opposite to the first cover 105. The first voice coil 1061 and the second voice coil 1071 are electrically connected to the terminal. The terminal 109 transmits electrical signals to the first voice coil 1061 and the second voice coil 1071.

Specifically, as shown in FIG. 3 and FIG. 4, a first slot 1012 and a second slot 1013 are formed on the outer periphery of the frame 101. A third slot 1050 is formed on the first cover 105 and aligned with the second slot 1013. The coaxial speaker 100 can further include a first wire 115 and a second wire 116. The first wire 115 passes through the first slot 1012 for electrically connecting the first voice coil 1061 and the terminal 109, and the second wire 116 passes through the third slot 1050 and the second slot 1013 for electrically connecting the second voice coil 1071 and the terminal 109.

Furthermore, a plurality of long slots 1051 is formed on the first cover 105 for allowing air to flow through. The anti-dust mesh 110 is disposed on the first cover 105 for preventing dust from dropping into the coaxial speaker 100 via the plurality of long slots 1051 of the first cover 105. A plurality of communicating slots 1014 is formed on the outer periphery of the frame 101 and corresponding to the first diaphragm 1060. The damping component 112 is disposed on the side of the outer periphery of the frame 101 opposite to the first cover 105 for dustproof function and regulating an air flow rate passing through the plurality of communicating slots 1014 so as to adjust the sound characteristic. As shown in FIG. 3 and FIG. 4, in this embodiment, a notch 1120 can be formed on the damping component 112 and corresponding to the terminal 109 for preventing interference with the terminal 109, i.e., the damping component 112 can be formed in a C shape. Furthermore, a communicating hole 1015 is formed on the center of the frame 101 and corresponding to the second diaphragm 1070. Preferably, the communicating hole 1015 is formed on the column 1011. The damping element 111 is disposed on the center of the frame 101 opposite to the second cover 108 for dustproof function and regulating an air flow rate passing through the communicating hole 1015 so as to adjust the sound characteristic. As shown in FIG. 5, the damping element 111 can be formed in a circular shape.

The operational principle of the coaxial speaker 100 is described as follows. As shown in FIG. 5, when the coaxial speaker 100 is in use, the terminal 109 can transmit electrical signals to the first voice coil 1061 and the second voice coil 1071 via the first wire and the second wire. Therefore, the first voice coil 1061 and the second voice coil 1071 can be driven to move back and forth by the two independent magnetic loops in the first accommodating space 113 and the second accommodating space 114 respectively, such that the first voice coil 1061 drives the first diaphragm 1060 to vibrate for generating sound waves with low audio frequencies and middle audio frequencies, and the second voice coil 1071 drives the second diaphragm 1070 to vibrate for generating sound waves with high audio frequencies. Therefore, the coaxial speaker of the present invention has better sound quality compared to sound quality of the conventional speaker including only one speaker unit. Furthermore, it should be noticed that since the first diaphragm 1060 and the second diaphragm 1070 can be substantially located in a same plane and vibrate along a same axis, phase difference between sound signals with different frequencies is effectively reduced. It can prevent interference of sound fields generated by different speaker units in the prior art.

In contrast to the prior art, the coaxial speaker of the present invention utilizes the magnetic component, the magnetic steel component, and the magnetic conductive component for establishing two independent magnetic loops in the first accommodating space and the second accommodating space. In such a way, the first voice coil disposed in the first accommodating space and the second voice coil disposed in the second accommodating space are driven by the two magnetic loops to drive the first diaphragm and the second diaphragm to vibrate for generating sound waves with low audio frequencies, middle audio frequencies, and high audio frequencies respectively. Therefore, the coaxial speaker of the present invention not only saves mechanical space but also enhances sound quality in high frequencies, middle frequencies, and low frequencies. Furthermore, since the first diagram and the second diagram are substantially located at the same plane, the coaxial speaker improves sound localization and reduces phase difference between sound signals.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A coaxial speaker comprising:

a frame, a recess being formed on the frame;

a magnetic steel component disposed inside the recess, an outer periphery of the magnetic steel component protruding from a base of the magnetic steel component;

a magnetic component disposed on the base of the magnetic steel component;

a magnetic conductive component disposed on the magnetic component, a first accommodating space being formed among the magnetic component, an outer periphery of the magnetic conductive component, and the magnetic steel component, and a second accommodating space being formed among the magnetic component, an inner periphery of the magnetic conductive component, the base of the magnetic steel component, and the frame;

a first cover, an outer periphery of the first cover being fixed on the frame, and an inner periphery of the first cover being fixed on the magnetic conductive component;

a first speaker assembly comprising:

a first diaphragm fixed between the first cover and the frame, the first diaphragm comprising a first fixing structure protruding toward the first accommodating space; and a first voice coil disposed in the first accommodating space and fixed on the first fixing structure; and a second speaker assembly comprising:

a second diaphragm fixed on the inner periphery of the first cover, the second diaphragm comprising a second fixing structure protruding toward the second accommodating space; and a second voice coil disposed in the second accommodating space and fixed on the second fixing structure.

2. The coaxial speaker of claim 1, further comprising a second cover disposed on the first cover at a location between the outer periphery of the first cover and the inner periphery of the first cover for covering the second speaker assembly.

3. The coaxial speaker of claim 1, further comprising a terminal disposed on a side of the outer periphery of the frame opposite to the first cover, and the first voice coil and the second voice coil being electrically connected to the terminal.

4. The coaxial speaker of claim 3, wherein a first slot and a second slot are formed on the outer periphery of the frame, a third slot is formed on the first cover and aligned with the second slot, the coaxial speaker further comprises a first wire and a second wire, the first wire passes through the first slot for electrically connecting the first voice coil to the terminal, and the second wire passes through the third slot and the second slot for electrically connecting the second voice coil to the terminal.

5. The coaxial speaker of claim 1, wherein a plurality of communicating slots is formed on the outer periphery of the frame and corresponding to the first diaphragm, the coaxial speaker further comprises a damping component disposed on a side of the outer periphery of the frame opposite to the first cover for regulating an air flow rate passing through the plurality of communicating slots.

6. The coaxial speaker of claim 5, wherein a notch is formed on the damping component and corresponding to the terminal, such that the damping component is formed in a C shape.

7. The coaxial speaker of claim 1, wherein a communicating hole is formed on a center of the frame and corresponding to the second diaphragm, the coaxial speaker further comprises a damping element disposed on the center of the frame opposite to the second cover for regulating an air flow rate passing through the communicating hole.

8. The coaxial speaker of claim 1, wherein the damping element is formed in a circular shape.

9. The coaxial speaker of claim 1, wherein the first diaphragm and the second diaphragm are located in a same plane.

10. The coaxial speaker of claim 1, wherein the first diaphragm is formed in a ring shape, an outer periphery of the first diaphragm is fixed between the first cover and the frame, and the first fixing structure is disposed on an inner periphery of the first diaphragm.

11. The coaxial speaker of claim 1, wherein the second diaphragm is formed in a circular shape, and an outer periphery of the second diaphragm is fixed on the inner periphery of the first cover.

12. The coaxial speaker of claim 1, further comprising an anti-dust mesh disposed on the first cover.

* * * * *